US008387489B2

(12) United States Patent
Hsu

(10) Patent No.: US 8,387,489 B2
(45) Date of Patent: Mar. 5, 2013

(54) MULTI-SIZE RATCHET WRENCH

(76) Inventor: Jung-Chou Hsu, Taichung (TW)

( * ) Notice: Subject to any disclaimer, the term of this patent is extended or adjusted under 35 U.S.C. 154(b) by 255 days.

(21) Appl. No.: 12/882,206

(22) Filed: Sep. 15, 2010

(65) Prior Publication Data

US 2012/0060653 A1 Mar. 15, 2012

(51) Int. Cl.
*B25B 13/46* (2006.01)
*B25B 13/06* (2006.01)

(52) U.S. Cl. ..... 81/62; 81/63.2; 81/124.5

(58) Field of Classification Search ..... 81/60–63.2, 81/124.4, 124.5
See application file for complete search history.

(56) References Cited

U.S. PATENT DOCUMENTS 1,431,064 A * 10/1922 Treisch ..... 81/63.2
1,811,137 A * 6/1931 Kress ..... 81/124.3
4,515,044 A * 5/1985 Harstad ..... 81/61
7,146,881 B2 * 12/2006 Chang ..... 81/62
7,207,244 B2 * 4/2007 Chen ..... 81/63.2
7,313,987 B1 * 1/2008 Chen et al. ..... 81/63.1
7,331,259 B1 * 2/2008 Chen ..... 81/63
7,444,904 B2 * 11/2008 Huang ..... 81/63.2
7,966,912 B1 * 6/2011 Hobden et al. ..... 81/63
2006/0230883 A1 * 10/2006 Ling et al. ..... 81/63.2
2007/0256524 A1 * 11/2007 Cornwell et al. ..... 81/57.3
2007/0277652 A1 * 12/2007 Tuan-Mu ..... 81/63
2009/0320649 A1 * 12/2009 Hu ..... 81/63.1
2010/0275737 A1 * 11/2010 Lin ..... 81/63
2011/0017024 A1 * 1/2011 Kriz ..... 81/60
2011/0132149 A1 * 6/2011 Lee ..... 81/63.1

* cited by examiner

*Primary Examiner* — David B Thomas
(74) *Attorney, Agent, or Firm* — Leong C. Lei

(57) ABSTRACT

A multi-size ratchet wrench, which is easy to operate and is of multiple sizes, includes a wrench handle having two ends, at least one of which forms a head that receives and retains therein a fitting assembly that effect single direction driving. The fitting assembly rotatably supports a rotatable block that has a rotational axis substantially perpendicular to a rotational axis of the fitting assembly. The rotatable block has a circumferential surface forming one or multiple fitting sections that are substantially normal to the rotational axis of the rotatable block. This arrangement allows a user to select among differently-sized fitting sections through direct rotation of the rotatable block. Thus, the number of sockets to be carried and times of replacing sockets are both reduced. Further, the single direction driving allows the wrench handle make loaded driving of the fitting assembly in one direction and load-free rotation in an opposite direction.

2 Claims, 6 Drawing Sheets

MULTI-SIZE RATCHET WRENCH

TECHNICAL FIELD OF THE INVENTION

The present invention generally relates to a ratchet wrench, and more particularly to a multi-size ratchet wrench that comprises a rotatable blocking forming a number of differently sized fitting sections to selectively fit to work pieces of different sizes.

DESCRIPTION OF THE PRIOR ART

A conventional ratchet wrench has a general construction as shown in FIGS. 1 and 2, comprising a wrench handle 10 having two ends of which at least one forms a head 15. The head 15 comprises a fitting square 16 that is driven through a one-way clutch element (not shown in the drawings) to provide the fitting square 16 with a one-way driving function. The head 15 is also provided with a switch bar 17 that is operable to control the one-way clutch element to select the rotational direction of the fitting square 16 sp as to switch the direction along which the fitting square 16 drives. The fitting square 16 is selectively fit to a fitting hole 21 formed in a socket 20. Different sockets 20 have fitting sections 22 of different sizes, and the fitting sections 22 are used to fit to a work piece to tighten or loosen the work piece.

A conventional ratchet wrench set usually comprises a single wrench handle 10 that can work with a number of sockets 20 of various sizes. In other words, each socket 20 is of a fixed size and replacement of the socket often occurs when the tool is to work with work pieces of different sizes, to which different sockets correspond. Thus, a wrench operator must carry a number of sockets 20 of different sizes and removal and refitting among sockets must be frequently don to cope with work pieces of different sizes. This significantly increases times of replacement and requires an extended period of time in operation, eventually leading to inconvenience and inefficiency of use of tool.

Further, the existing sockets 20 are designed in such a way that the fitting section 22 shows an axial line that is coincident with a central axis of the fitting hole. This imposes a limitation in the flexibility of design of the socket 20 that provides multiple fitting sections 22 of different sizes. Further, the combined length of the fitting square 16 and the socket 20 substantially projects out of the wrench handle 10, forming an L-shape. This makes it hard to reduce the overall volume and leads to inefficiency of storage and shipping. Also, during use of the tool, it easily occurs that the exposure of the fitting square 16 and the socket 20 attached thereto may cause undesired impact, affecting the efficiency and convenience of using the tool. This certainly causes problems in relation to operation safety.

SUMMARY OF THE INVENTION

Thus, a primary objective of the present invention is to provide a multi-size ratchet wrench, which allows for efficient switching among various sizes and also shows convenience and efficiency of use and operation.

Another objective of the present invention is to provide a multi-size ratchet wrench, which allows for reduction of overall volume so as to improve the convenience and efficiency of carrying and storage and enhance operation safety.

To achieve the above objectives, the present invention provides a multi-size ratchet wrench, which comprises a wrench handle having two ends, at least one of which forms a head that receives and retains therein a fitting assembly that effect single direction driving. The fitting assembly rotatably supports a rotatable block that has a rotational axis substantially perpendicular to a rotational axis of the fitting assembly. The rotatable block has a circumferential surface forming one or multiple fitting sections that are substantially normal to the rotational axis of the rotatable block. This arrangement allows a user to select among differently-sized fitting sections through direct rotation of the rotatable block. Thus, the number of sockets to be carried and times of replacing sockets are both reduced. Further, the single direction driving allows the wrench handle make loaded driving of the fitting assembly in one direction and load-free rotation in an opposite direction, so that convenience and efficiency of operation can be realized.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 3:
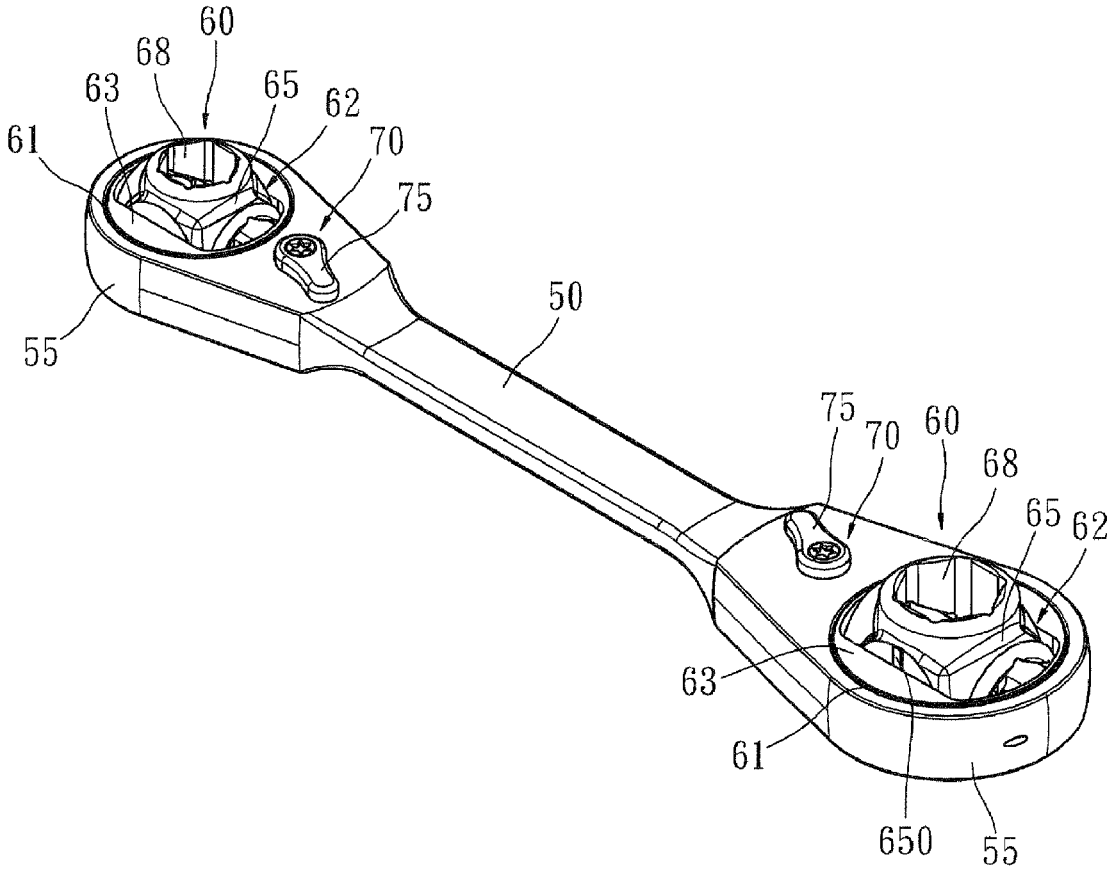
FIG. 3 is a perspective view showing a ratchet wrench according to the present invention.

The present invention provides a multi-size ratchet wrench, of which a perspective view is shown in FIG. 3. The ratchet wrench of the present invention comprises a wrench handle 50, which has two ends of which at least one forms a head 55. The head 55 comprises a fitting assembly 60 that provides a one-way driving function. The fitting assembly 60 comprises a rotatable block 65 that forms a plurality of fitting sections 68. Further, the head 55 comprises a switch lever assembly 70 for selecting/switching driving direction of the fitting assembly 60.

A detailed description of the present invention will be given with a preferred embodiment thereof with reference to FIGS. 3-6. The head 55 of the wrench handle 50 forms, at a front portion thereof, a wheel compartment 56, which receives the fitting assembly 60 to be arranged therein, and also forms, at a rear portion thereof, a switch compartment 58 that communicates the wheel compartment 56 to receive the switch lever assembly 70 therein. The switch compartment 58 has an inside circumferential wall in which a receiving hole 580 is formed to correspond to the switch lever assembly 70. Further, the wheel compartment 56 and the switch compartment 58 are provided at a top thereof with a cover ring 59 that is retained by a circlip 590 and a retention ring 69 that forms inward flanges 690. The cover ring 59 and the retention ring 69 help retaining the fitting assembly 60 and the switch lever assembly 70 inside the compartments defined in the head 55.

The fitting assembly 60 comprises a ratchet wheel 61 and a rotatable block 65. The ratchet wheel 61 is received in the wheel compartment 56 and forms a centrally located through channel 62 in which a rotatable block 65 is received. The ratchet wheel 61 forms, along an inside circumference of the through channel 62, two opposite bearing portions 63, which respectively form aligned shaft notches 64 for rotatably supporting the rotatable block 65. At least one of the two bearing portions 63 has a surface facing the rotatable block 65 and the ratchet wheel 61 forms one or a plurality of receiving holes 630, each of which receives and retains therein a resilient positioning assembly 631 that functions to releasably fix the rotatable block 65 at one of selected angular positions. According to the present invention, the resilient positioning assembly 631 is composed of a detent ball and a biasing spring. Two aligned shaft portions 66 extend respectively from opposite surfaces of the rotatable block 65 and correspond to the shaft notches 64, whereby the rotatable block 65 is rotatably received and supported in the ratchet wheel 61 in such a way that a rotational axis of the rotatable block 65 is substantially perpendicular to a rotational axis of the fitting assembly 60. Further, the rotatable block 65 forms in a circumferential surface thereof the plurality of fitting sections 68, each of which extends in a direction substantially perpendicular to the rotational axis of the rotatable block. In the embodiment illustrated, the rotatable block 65 forms four fitting sections 68, which are of different sizes for fitting to work pieces of different sizes. Further, the rotatable block 65 has two side surfaces opposing the bearing portions 63 and at least one of the side surfaces forms one or a plurality of positioning slots 650 associated with the fitting sections 68 and engageable with the resilient positioning assembly 631 for positioning purposes, whereby the rotatable block 65 can be rotated and positioned at any specific one of the selected angular positions to set an associated one of the fitting sections 68 to face downward.

Figure 6:
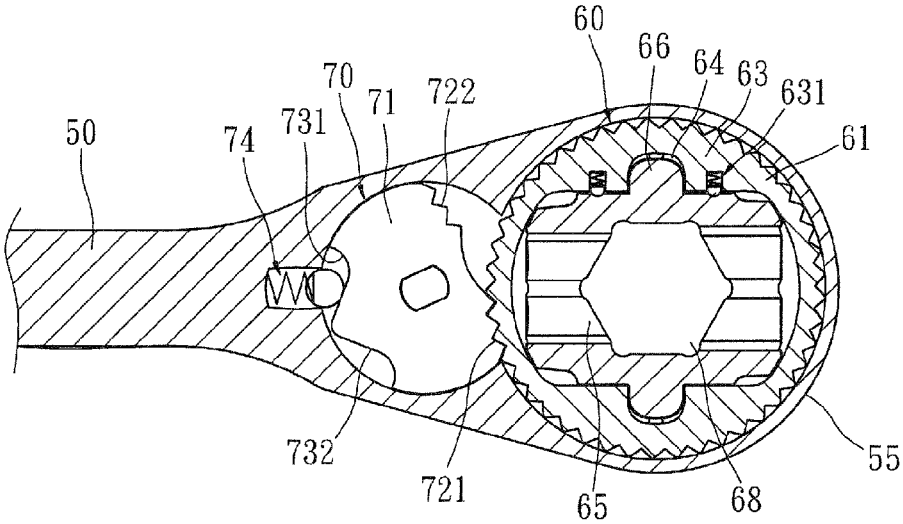
FIG. 6 is a cross-sectional view showing inside details of the ratchet wrench according to the present invention.
Figure 7:
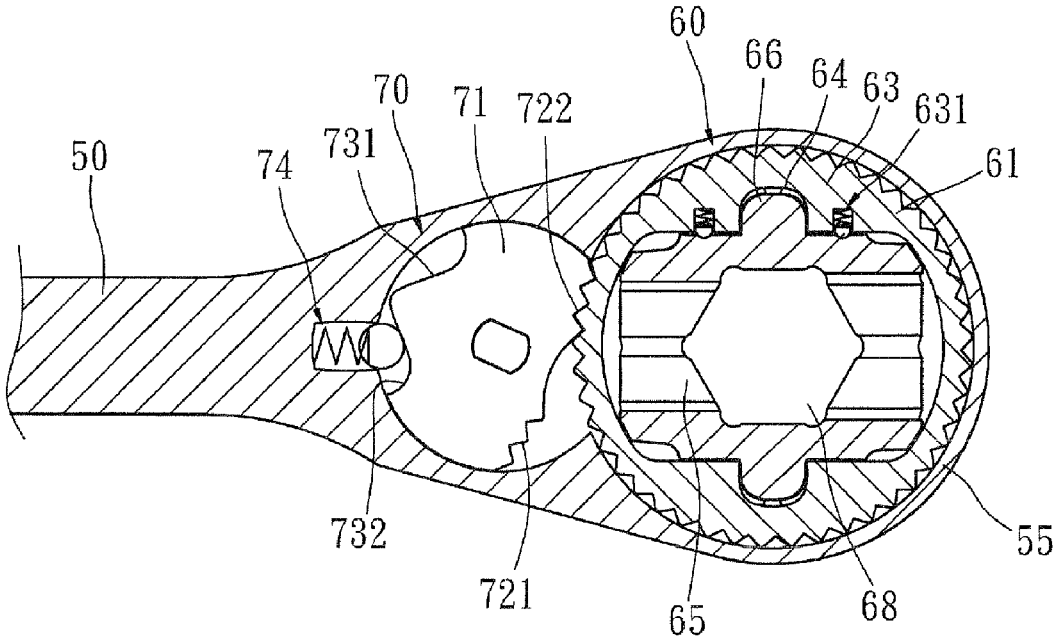
FIG. 7 is another cross-sectional view showing inside details of the ratchet wrench according to the present invention.

The switch lever assembly 70 comprises a pawl block 71 received in the switch compartment 58. The pawl block 71 has an end facing the circumference of the ratchet wheel 61 and forming a first toothed section 721 and a second toothed section 722, which function to respectively limit the rotation of the ratchet wheel 61 in opposite directions (as shown in FIGS. 6 and 7 respectively). Further, the pawl block 71 has an opposite end that forms a first holding notch 731 and a second holding notch 732 respectively corresponding to the first and second toothed sections 721, 722. The receiving hole 580 receives and retains therein a resilient holding assembly 74, which in the embodiment illustrated is composed of a detent ball and a biasing spring, whereby after the pawl block 71 is switched to have the first and second toothed sections 721, 722 selectively engage the ratchet wheel 61, the resilient holding assembly 74 applies a spring force acting on either one of the first and second holding notches 731, 732 of the pawl block 71 to provide a resilient positioning and holding effect (as shown in FIGS. 6 and 7 respectively). Further, the switch lever assembly 70 comprises a switch lever 75 extending out of the switch compartment 58 to allow for manual operation of the switch lever 75 to drive the first and second toothed sections 721, 722 of the pawl block 71 to selectively engage the ratchet wheel 61 for switching the driving direction of the ratchet wheel 61.

As such, a multi-size ratchet wrench that allows for efficient switching among different sizes and shows a reduced volume is provided.

Figure 5:
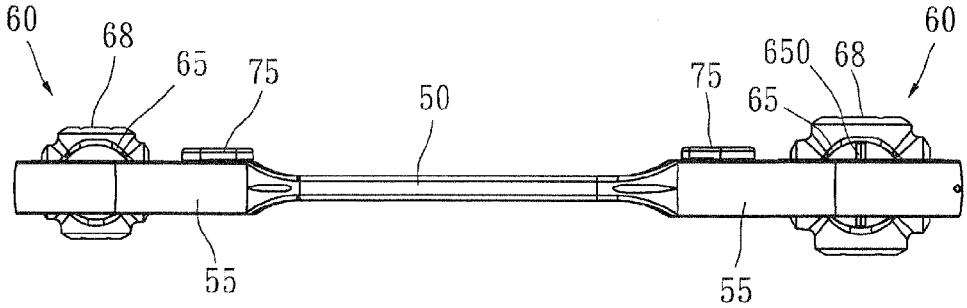
FIG. 5 is a side elevational view of the ratchet wrench according to the present invention.

To operate the present invention, as shown in FIGS. 5-7, when it needs to change the operation direction, the switch lever 75 is moved to have the first and second toothed sections 721, 722 of the pawl block 71 selectively engage the ratchet wheel 61 (as shown in FIG. 6 or 7), so as to have the pawl block 71 operatively engages the ratchet wheel 61 in a single given direction, making the ratchet wheel 61 drive a ratcheting operation of the rotatable block 65 for loaded rotation in a single given direction, but being of load-free rotation in an opposite direction. The ratchet wrench may then selectively fit any one of the fitting sections 68 of the rotatable block 65 to a workpiece for tightening or loosening operation of the workpiece.

Figure 4:
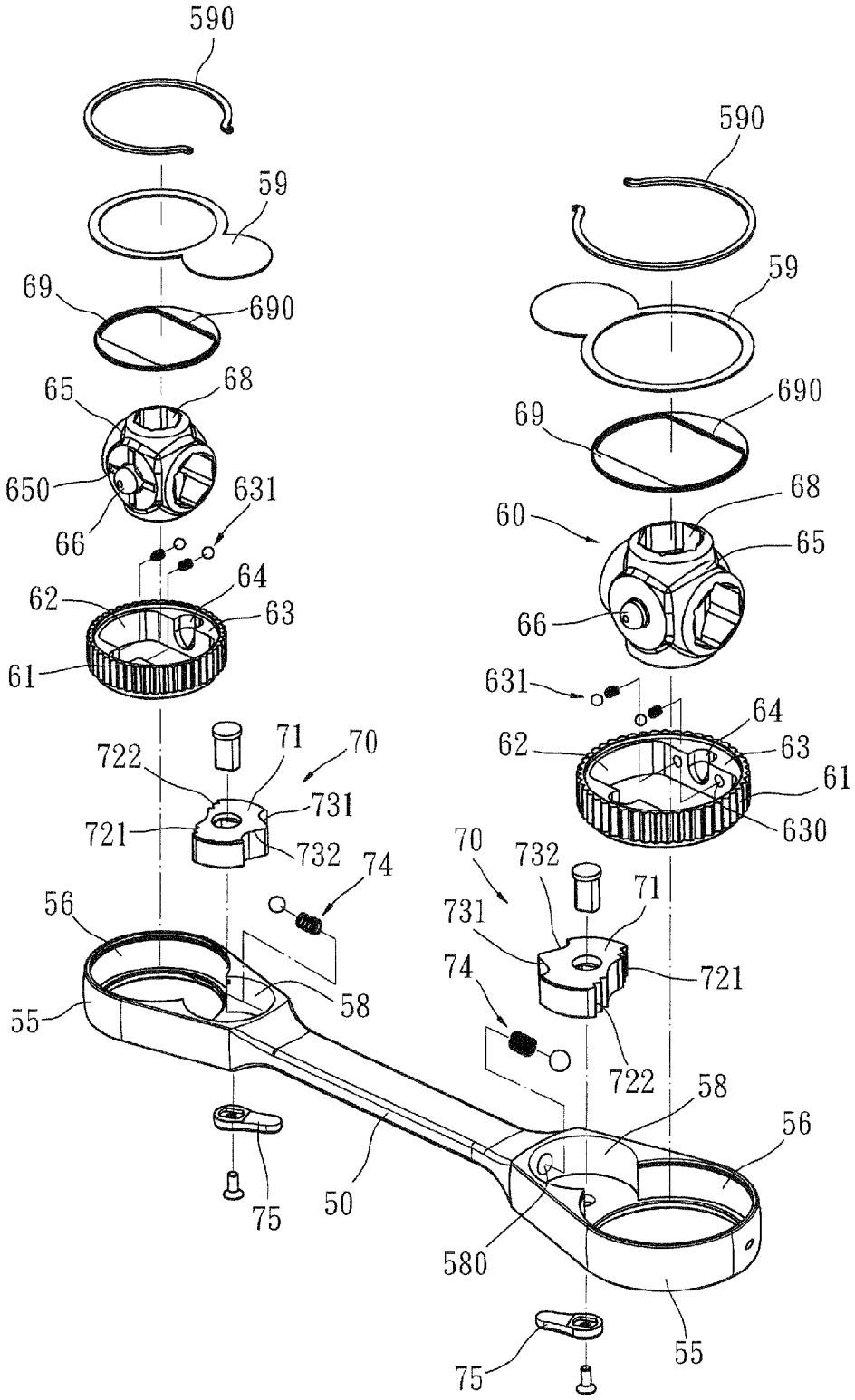
FIG. 4 is an exploded view of the ratchet wrench according to the present invention.

To switch to another one of the fitting sections 68 having a different size, as shown in FIGS. 3-5, according to the size of the work piece to be tightened/loosened, the rotatable block 65 is made rotating through the shaft portions 66 rotating in the shaft notches 64 of the ratchet wheel 61 to such an extent that a desired one of the fitting sections 68 of the rotatable block 65 corresponding to the size of the work piece is positioned to face downward. Once the rotatable block 65 is set to the desired angular position, the positioning slots 650 of the rotatable block 65 are allowed to engage the resilient positioning assemblies 631 within the through channel 62 of the ratchet wheel 61 for positioning and fixing the rotatable block 65, whereby the rotatable block 65 is fixed against undesired rotation about the rotational axis thereof during the operation of the tool but still allows for efficient switching among the differently-sized fitting sections 68 to improve the convenience of operation.

The above description of the structure and operation of the present invention shows that the ratchet wrench according to the present invention features an integrated and multi-sized structure of multiple differently sized fitting sections 68 formed in a one-piece rotatable block 65, allowing a user to select or switch among the differently sized fitting sections through direct rotation of the rotatable block 65 for selection of a desired size of the fitting sections 68. As compared to the existing socket wrenches, the number of sockets that is carried in performing an operation is reduced and the switching among different sizes is made efficient. Further, the ratchet wrench according to the present invention allows for single direction driving for selectively tightening or loosening a work piece, and thus the present invention shows both convenience and efficiency of operation.

Figure 1:
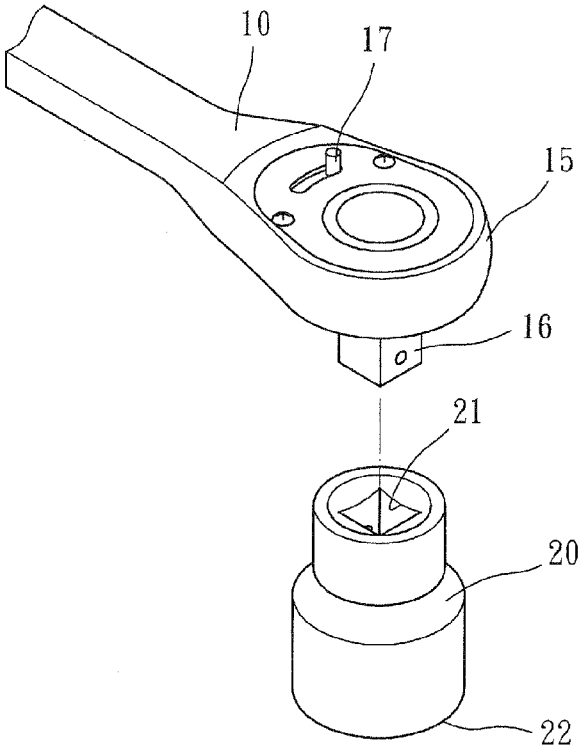
FIG.1 PRIOR ART
FIG. 1 is a perspective view showing a conventional ratchet wrench.
Figure 2:
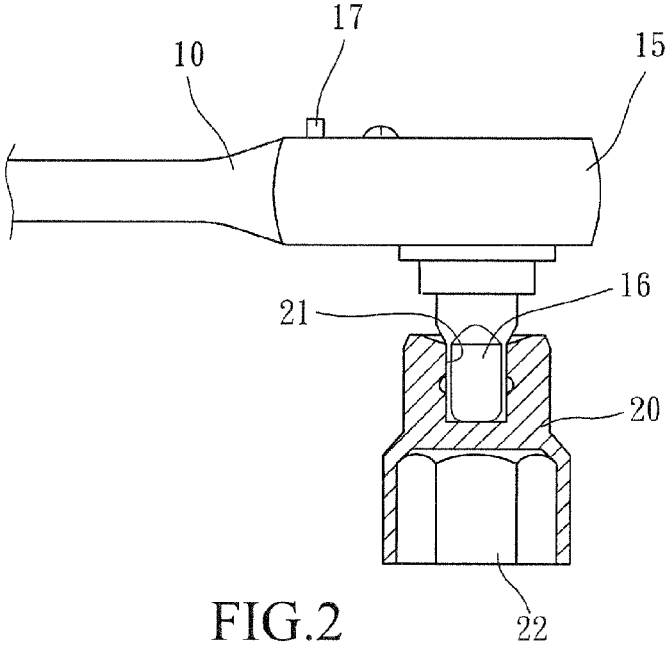
FIG.2 PRIOR ART
FIG. 2 is a side elevational view, partly section, showing the conventional ratchet wrench.

Further, the rotatable block 65 according to the present invention is received inside the ratchet wheel 61, so that the distance that the fitting sections 68 of the rotatable block 65 projects outward, when viewed sideways, is much less than that of combined length of a fitting square 16 of a conventional socket wrench and a socket 20 attached thereto (as respectively shown in FIGS. 2 and 5). Thus, the present invention can effectively reduce the overall volume and shows a substantially flat configuration as a whole. This reduces the amount of space that is needed for storage and shipping and also eliminates undesired impacts during the operation of the tool, thereby improving safety and convenience of operation and use.

Figure 8:
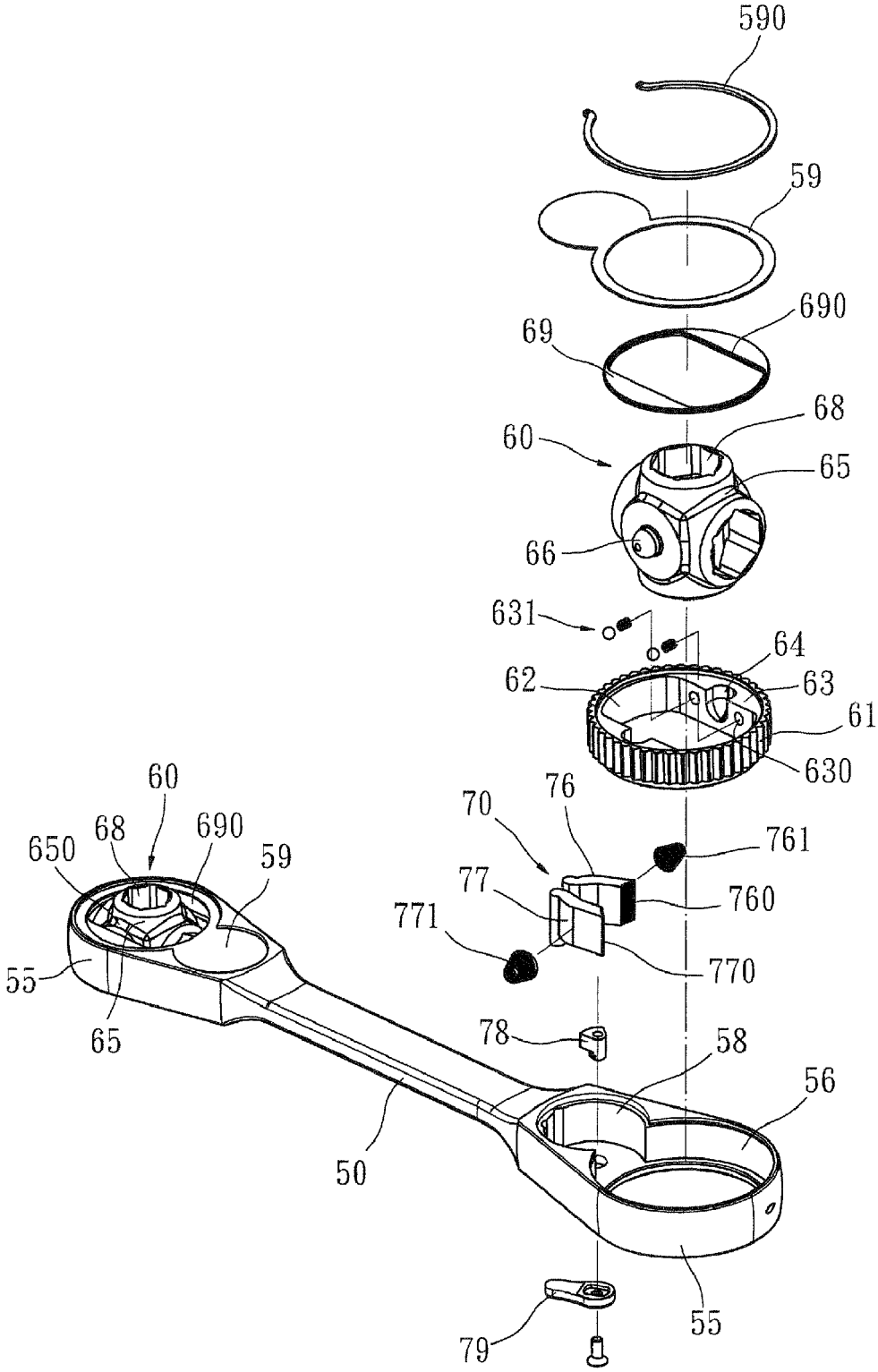
FIG. 8 is an exploded view showing a ratchet wrench according to another embodiment of the present invention.

Another embodiment of the present invention is shown in FIG. 8, wherein the ratchet wrench comprises a switch lever assembly 70 that comprises two pawl blocks 76, 77 that are rotatably mounted inside a switch compartment 58. Each of the two pawl blocks 76, 77 has an end facing a circumference of a ratchet wheel 61 and forming a toothed section 760, 770. The two pawl blocks 76, 77 are selectively engageable with different portions of the circumference of the ratchet wheel 61. Each of the pawl blocks 76, 77 has an outside surface, which supports an elastic element 761, 771 with respect to an inside surface of the switch compartment 58 to apply a returning spring force to the pawl block 76, 77 after movement of the pawl block. The switch compartment 58 receives therein a push block 78, which selectively pushes and moves the pawl blocks 76, 77. The head 55 is provided, at an outside surface thereon, with a switch lever 79 that controls the push block 78, whereby with the operation of the switch lever 79, the push block 78 is actuated to selectively push and move the two pawl blocks 76, 77 for switching the driving direction of the ratchet wheel 61 caused by the wrench handle 50. This arrangement provides the same advantages and practical values as the previous embodiment.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-size ratchet wrench, comprising a wrench handle having two ends of which at least one forms a head, which comprises a fitting assembly adapted to drive a work piece, the head further comprising a switch lever assembly for switchably setting the fitting assembly to a driving direction; wherein the fitting assembly comprises a ratchet wheel arranged inside the head and a rotatable block arranged inside the ratchet wheel, the ratchet wheel forming a centrally located through channel having opposite bearing portions, the rotatable block being rotatable inside the ratchet wheel about a first rotational axis that is perpendicular to a second rotational axis of the ratchet wheel of the fitting assembly, the rotatable block having a circumferential surface forming one or a plurality of fitting sections that is perpendicular to the first rotational axis, the head of the wrench handle having a wheel compartment in which the fitting assembly is received, the head also having at a different portion a switch compartment that communicates the wheel compartment and receives switch lever assembly therein, the wheel compartment and the switch compartment being provided at a top thereof with a cover ring that is retained in positioned by a circlip, the two bearing portions of the ratchet wheel of the fitting assembly having opposite and aligned shaft notches, the rotatable block having opposite side surfaces forming shaft portions corresponding to the shaft notches, one of the bearing portions of the ratchet wheel of the fitting assembly having a surface facing the rotatable block and forming one or a plurality of receiving holes, each of which receives and retains therein a resilient positioning assembly that functions to releasably fix the rotatable block, the rotatable block having a surface forming one or a plurality of positioning slots corresponding and engageable with the resilient positioning assemblies, the switch lever assembly comprising a pawl block arranged inside the head, the pawl block having an end facing a circumference of the ratchet wheel and forming a first toothed section and a second toothed section and an opposite end forming a first holding notch and a second holding notch respectively corresponding to the first and second toothed sections, the head receiving therein a resilient holding assembly that releasably holds the pawl block in position, the switch lever assembly further comprising a switch lever extending outside the head.

2. The multi-size ratchet wrench according to claim 1, wherein one of the bearing portions of the ratchet wheel of the fitting assembly has a surface facing the rotatable block and forming one or a plurality of receiving holes, each of which receives and retains therein a resilient positioning assembly that functions to releasably fix the rotatable block, the rotatable block having a surface forming one or a plurality of positioning slots corresponding and engageable with the resilient positioning assemblies.

* * * * *